US006334799B1

(12) United States Patent
Delpozo et al.

(10) Patent No.: US 6,334,799 B1
(45) Date of Patent: Jan. 1, 2002

(54) BODY BOARD

(76) Inventors: Rene Delpozo, 6028 Sanctuary Garden Blvd., Port Orange, FL (US) 32124; Maselusa Naea, 1743 Cedar St., Rockledge, FL (US) 32955

( * ) Notice: Subject to any disclaimer, the term of this patent is extended or adjusted under 35 U.S.C. 154(b) by 0 days.

(21) Appl. No.: 09/539,540

(22) Filed: Mar. 31, 2000

(51) Int. Cl.[7] ..... B63B 1/00
(52) U.S. Cl. ..... 441/65
(58) Field of Search ..... 441/65, 74

(56) References Cited

U.S. PATENT DOCUMENTS

| | | | | |
|---|---|---|---|---|
| 1,552,603 A | | 9/1925 | Hawks | |
| 1,843,617 A | | 2/1932 | Marshall | |
| 2,623,571 A | | 12/1952 | Damsch | 155/47 |
| 3,123,845 A | | 3/1964 | Girden | 9/311 |
| 3,803,652 A | | 4/1974 | Uyehara | 9/310 E |
| 3,902,207 A | * | 9/1975 | Tinkler et al. | 441/74 |
| 4,929,207 A | * | 5/1990 | Piatt | 441/65 |
| 5,101,752 A | * | 4/1992 | Smollar et al. | 441/65 |
| 5,116,269 A | | 5/1992 | Moran | 441/65 |
| 5,224,890 A | | 7/1993 | Moran | 441/65 |
| 5,476,403 A | | 12/1995 | Hsia | 441/74 |
| 5,569,057 A | | 10/1996 | Barsdorf et al. | 441/65 |
| 5,603,645 A | | 2/1997 | Saccomanno | 441/65 |
| 5,618,051 A | | 4/1997 | Kobylenski et al. | 280/14.2 |
| 5,658,179 A | | 8/1997 | Glydon et al. | 441/74 |
| 5,928,045 A | * | 7/1999 | Szabad | 441/65 |
| 6,213,831 B1 | * | 4/2001 | Smith | 441/65 |

* cited by examiner

*Primary Examiner*—Stephen Avila
(74) *Attorney, Agent, or Firm*—Brian S. Steinberger; Law Offices of Brian S. Steinberger

(57) ABSTRACT

A body surfing device for allowing a rider to bend an upper buoyant board relative to a lower buoyant board during a ride in order to allow enhanced flexibility and maneuverability when riding waves. The bending can come from a hinge, such as a rope cord interlaced between the upper board and the lower board. The hinge allows the device to be foldable so that combined with removable straps for attaching the lower board to the rider, the rider can walk with the attached device when entering and leaving the water. The straps can be used to attach a top edge of the lower board about the waist of the rider, and dual straps can be used to attach the lower board about each of the upper thigh regions of the rider. The device is light weight, buoyant and is easy to use by the rider in a folded position. The device can include a tip end on the upper board having inwardly angling upper and lower edges, and side edges having both inwardly angling upper and lower edges, so that the angled edges allow for less resistance of the device when moving through the water.

16 Claims, 2 Drawing Sheets

BODY BOARD

This invention relates to body surfing, and in particular to a two part body surfing board having an upper planar section shaped to conform to an upper torso of a rider, connected by a rope type hinge to a lower section having a shape that conforms to the waist, trunk, and upper thigh areas, with a waist strap and thigh straps for holding the two part board against the rider.

BACKGROUND AND PRIOR ART

Body surfing is a well known recreational sport where one rides waves facedown on their stomachs over various distances. Body surfing generally refers to swimming with a wave as the wave breaks and propels the swimmer toward shore. However, merely riding facedown on one's stomach can create problems such as exposing the body surfer to cuts, abrasions and injury to the exposed face, shoulders, chest, stomach, waist and upper thigh regions.

Over the years various types of devices have been proposed for the body surfer. See for example U.S. Pat. Nos.: 5,116,269 and 5,224,890 to Moran; 5,603,645 to Saccomanno; and 5,658,179 to Glydon et al. However, these boards are restricted to one piece boards that do not protect all the exposed body areas of the rider such as the rider's waist and thigh areas. Additionally, these boards can easily pull away from the rider during the wave ride, exposing the surfer's face, shoulders, chest, stomach and waist areas to injury. Furthermore, these boards must be separately carried by the rider when not in use taking up at least one of the rider's free hands in order to carry the board when entering and leaving the water.

Additional proposals have included attaching some mounting straps to the body surfing boards. See for example, U.S. Pat. Nos.: 3,803,652 to Uyehara; and 5,569,057 to Barsdorf et al. However, these devices generally require neck type straps that can inhibit the rider's flexibility when riding the waves, and can cause the rider's head to be aimed downward exposing the head to harm during a ride. Additionally, the sole neck strap of Uyehara '652 can potentially strangle a rider if the board becomes shifted sideways during a ride. Additionally, the multiple and elaborate straps and buckles of Barsdorf '057 would be time consuming and difficult to completely secure during a ride, and even more difficult, and uncomfortable to remove. Still furthermore, neither of these devices adequately protects the waist and upper thigh regions of the rider during a ride. Additionally, the elaborate straps in these devices would make the strapped on boards difficult to wear by the rider when the rider is both entering and leaving the water.

Still furthermore, none of the referenced patents allow for any flexibility and maneuverability of the board during a ride that would allow the board to bend and flex.

The inventors are aware of other types of devices. See for example, U.S. Pat. Nos.: 1,552,603 to Float; 1,843,617 to Marshall; 2,623,574 to Damsch; 3,123,845 to Girden; 5,476,403 to Hsia; and 5,618,051 to Kobylenski et al. Again, none of these cited patents overcomes all of the problems with the prior art described above.

SUMMARY OF THE INVENTION

The first objective of the present invention is to provide a body surfing board that protects the rider's shoulders, chest, stomach, waist and upper thighs during a ride.

The second object of this invention is to provide a body surfing board having straps for securing the board to the waist and upper thighs of the rider that keeps the board from shifting during the ride.

The third object of this invention is to provide a body surfing board that is both bendable and flexible to the rider.

The fourth object of this invention is to provide a body surfing board that can be safely and easily worn by the rider when entering and leaving the water.

The fifth object of this invention is to provide a body surfing board that can be folded when not being used.

The sixth object of this invention is to provide a lightweight and easy to carry buoyant body surfing board.

A preferred embodiment of the body surfing device includes an upper board being positioned below shoulders, chest and stomach of a rider, connected by a flexible hinge to a lower board being positioned below a waist and upper thigh regions of the rider, wherein the hinge allows the upper board to flex and bend relative to the lower board, and allows greater maneuverability when riding a wave. The lower board can be attached to the rider by a releasable waist strap and releasable upper thigh straps. The front edge, side edges and rear edge of the two board device can include angled edges, each having an inwardly upper angle of approximately 45 degrees and an inwardly lower angle of approximately 45 degrees. Additionally, all the exterior edges of the upper and lower board can be generally smooth and blunted so as not to injure the rider.

The upper board can have an indented and rounded upper end for being positioned under a neck of the rider, and outwardly expanding sides for being positioned under protruding elbows of the rider.

The hinge can be a rope type cord interlaced between the upper board and the lower board, or other types of flexing hinge materials, and the like. The upper board can be approximately 1¾ inches, which can be thicker than the lower board, which can be approximately 1¼ inches.

The upper and lower boards can be formed from layered materials such as plastic foams, polyurethane materials and the like, having flexible outer surfaces. The lower board can include a top edge for being positioned under the waist having a smaller width than the width of dual protruding bottom edges for being positioned under the upper thighs of the rider.

The lower board attachment straps can allow the device to be worn in a folded position on when the rider is walking into or out of the water, and allows the rider to have free use of their hands when not being used.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
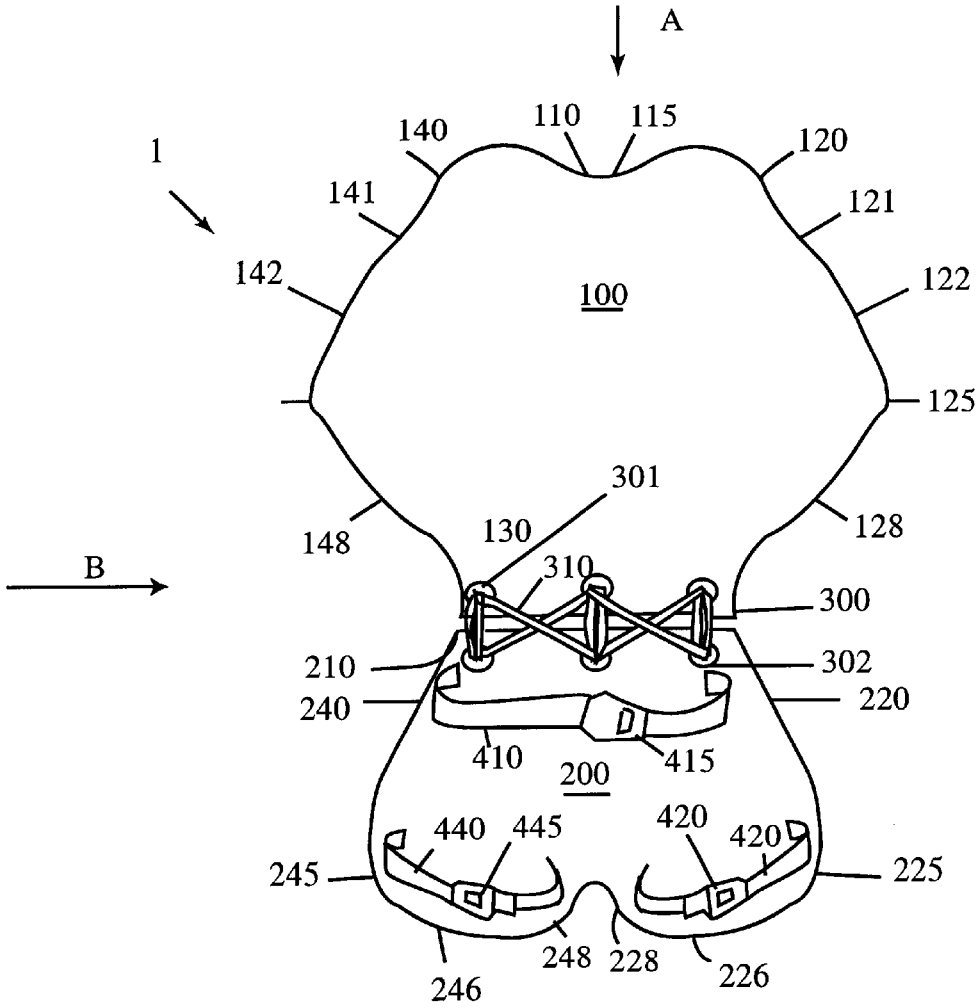
FIG. 1 is a top view of the novel two board body surfing device invention.
Figure 2:
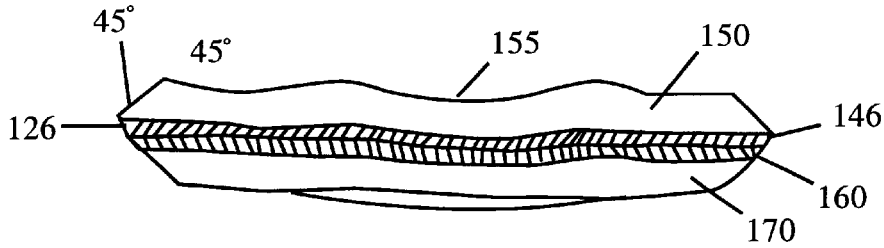
FIG. 2 is a front view of the body surfing device of FIG. 1 along arrow A.
Figure 3:
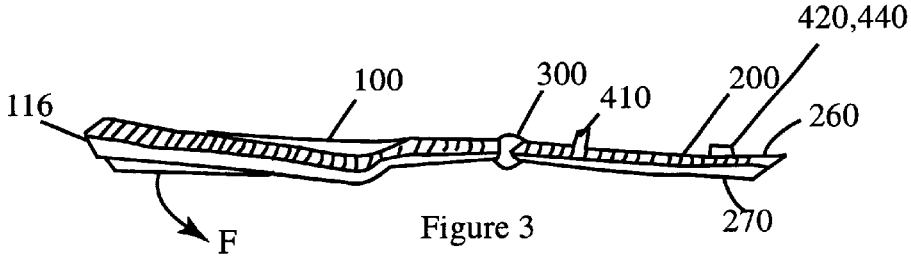
FIG. 3 is a side view of the device of FIG. 1 along arrow B.

FIG. 1 is a top view of the body surfing device invention 1 including an upper board 100 attached to a lower board 200 by a hinge 300. FIG. 2 is a front view of the body surfing device 1 of FIG. 1 along arrow A. FIG. 3 is a side view of the device 1 of FIG. 1 along arrow B. Referring to FIGS. 1–3, upper board 100 includes a top edge 110 having an inwardly rounded concave indentation 115 for fitting under a neck portion of a rider. On both sides of the upper board 100 are left upper side edge 140, right upper side edge 120, each expanding outward, and each having a small inward concave edges 141, 121, and peak extending convex side portions 145, 125, the latter for fitting under side protruding elbows of the rider(for example, when the rider's elbows are bent). From elbow edges 145, 125, the upper board width has a narrowing portion with convex edges 148, 128 to bottom substantially planar edge 130 which is intended to fit underneath the waist of the rider.

The upper board 100 can be layered to include three layers 150, 160, 170 that each can include outer layers 150, 170 having a flexible foam material sandwiched about a more rigid layer 160. The layers 150, 160, 170 can be formed from buoyant materials such as but not limited to polypropylene, polyurethane, and the like. The top layer 150 can include an indented surface 155 to better allow the upper board 100 to stay underneath the chest of the rider. The upper board can also be preformed from a single layer of material. The front tip end 116, and side edges 126, 146 of the upper board can have angled edges with an upward inward angle of approximately 45 degrees and a bottom inward angle of approximately 45 degrees to better allow the device more maneuverability as the board passes through the water during a wave ride. The upper board 100 can be thicker than the lower board 200, where the upper board can have a thickness of up to approximately 1¼ inches, and the lower board can have a thickness of approximately 1¼ inches.

The upper board bottom edge 130 can flexibly attach to the top edge 210 of the lower board 200 by interlacing a rope type cord 300 back and forth between a row of through-holes 301 in the upper board, and a row of through-holes 302 in the lower board 200. The rows of through-holes 301, 302 can be parallel to one another. The hinge 300 can be a cord such as but not limited to a nylon rope, a cotton rope, and the like. Alternatively, the hinge 300 can be a material such as a single flap, or plural flaps, other known hinges, and the like, that are fastened to the upper board and the lower board, by being sewn, woven, and by other known fastening techniques, and the like.

The lower board 200 includes a top edge 210 that can fit under the waist of the rider, and outwardly expanding convex left and right sides 240, 220, that expand outward to corners 245, 225 that would reach over the upper left and right thigh regions of the rider. Convex bottom edges 246, 226, each include inward indentations 248, 228 for fitting underneath the crotch area of the rider. The lower board 200 can include a top flexible material layer 260(similar to layer 160) over a more rigid material layer 270(similar to layer 170). Alternatively, the lower board 200 can be formed from the same three material layers as that as the upper board 100. The upper surface of the lower board 200 can also include some body indentations for forming a better fit with the rider. Lower board 200 can include the similar angled side edges and rear angled edge as the tip and side angled edges of upper board 100.

Referring to FIG. 1, lower board 200 can include size adjustable fastening straps 410, 420, 440 that can be affixed to the lower board 200 by known techniques, such as but not limited to being sewn thereon, snapped thereon, passes through openings in the board, and the like. Strap 410 has ends affixed to the waist area of lower board 200 so that the waist of the rider can be restrained during a wave ride, by a removable fastener 415, such as hook and loop fasteners, snaps, buckles, and the like. A left thigh restraint strap 440 having ends affixed to the left thigh region of the lower board 200, can include a removable fastener 445(similar to fastener 415) for restraining the left thigh of the rider. A right thigh restraint strap 420 having ends affixed to the right thigh region of the lower board 200, can include a removable fastener 425(similar to fasteners 415, 445) for restraining the right thigh of the rider. The restraining straps 410, 420, 440 allow the upper board to fold over in the direction of arrow F, relative to pivot point hinge 300, when the straps 410, 420, 440 are attached to the rider, and the rider is walking into or leaving from the water.

Figure 4:
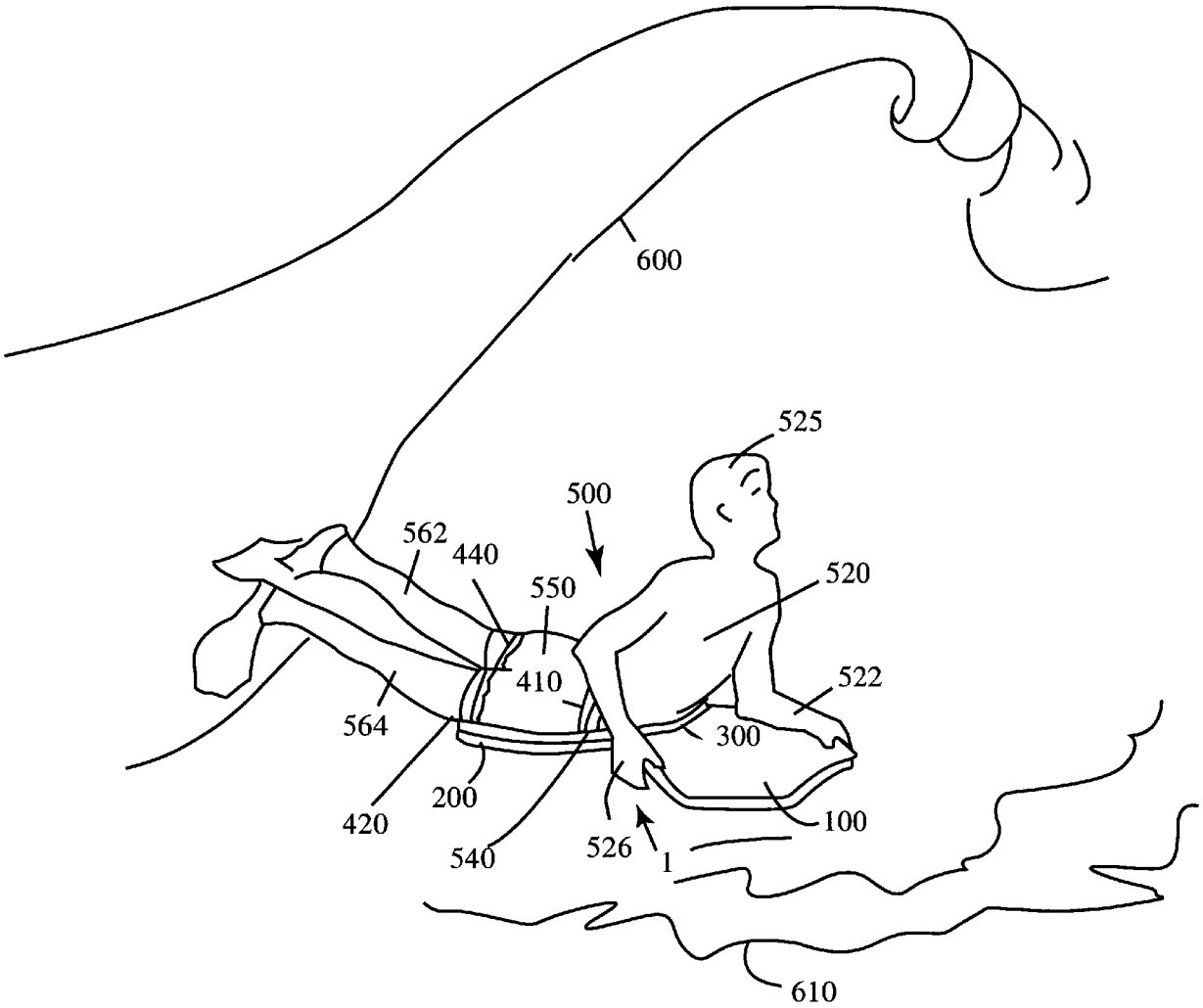
FIG. 4 is a perspective view of the device of FIG. 1 attached to a rider.

FIG. 4 is a perspective view of the device 1 of FIG. 1 attached to a rider 500 riding a wave 600. The rider's head 525 can be held above the upper board 100, by the rider 500 holding side edges of the upper board 100 by their left and right hands 522, 526. Flexible hinge 300 allows for enhanced flexibility and maneuverability of the rider 500 riding the rising and dropping wave 600. A portion of the lower torso can be attached to the device 1 by the waist strap 410, left upper thigh strap region 440, and right upper thigh region strap 420. The rider's left and right legs 562, 564 are unencumbered by the device 1, and can further propel the rider by kicking, and maneuvering the rider 500. The upper board 100 and lower board 200 can further protect the rider 500 from getting injured by protecting the chest, shoulders, stomach, waist and upper thigh regions of the rider 500 which are the most exposed areas to possible injury by an irregular shoreline surface 610, such as rocks, shells, debris, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A body surfing device comprising:

an upper board being positioned below shoulders, chest and stomach of a rider;

a lower board being positioned below a waist and upper thigh regions of the rider; and a hinge for connecting the upper board to the lower board, the hinge allowing the upper board to bend substantially upward and substantially downward relative to the lower board, wherein the rider using the device bends and flexes the upper board relative to the lower board.

2. The body surfing device of claim 1, further comprising:

a releasable attachment for connecting a lower torso portion of the rider to the device.

3. The body surfing device of claim 2, wherein the releasable attachment includes:

a waist strap for attaching the waist of the rider to the lower board.

4. The body surfing device of claim 2, wherein the releasable attachment includes:

straps for attaching the upper thighs of the rider to the lower board.

5. The body surfing device of claim 2, wherein the releasable attachment includes:

a waist strap for attaching the waist of the rider to the lower board; and straps for attaching the upper thighs of the rider to the lower board.

6. The body surfing device of claim 1, wherein the upper board includes:

an angled tip end.

7. The body surfing device of claim 6, wherein the angled tip includes:

an inward upper angle of approximately 45 degrees from the tip end; and an inward lower angle of approximately 45 degrees from the tip end.

8. The body surfing device of claim 1, wherein the upper board and the lower board include:

angled side edges.

9. The body surfing device of claim 8, wherein the angled side edges includes:

an inward upper angle of approximately 45 degrees; and an inward lower angle of approximately 45 degrees.

10. The body surfing device of claim 1, wherein the upper board includes:

an indented and rounded upper end for being positioned under a neck of the rider; and sides which expand outward for being positioned under protruding elbows of the rider.

11. The body surfing device of claim 1, wherein the hinge includes:

a cord laced between the upper board and the lower board.

12. The body surfing device of claim 1, wherein the upper board is thicker than the lower board.

13. The body surfing device of claim 12, wherein the upper board is approximately 1¾ inches and the lower board is approximately 1¼ inches.

14. The body surfing device of claim 1, wherein the lower board includes:

a top edge for being positioned under the waist having a smaller width than a bottom edge for being positioned under the upper thighs of the rider.

15. The body surfing device of claim 1, wherein the hinge includes:

a foldable hinge that allows a portion of the upper board to fold against a portion of the lower board for ease in carrying and storing the device.

16. A body surfing device, comprising:

a board for abutting against at least an upper torso region of a rider;

an indented and rounded upper end portion on the board for being positioned under a neck of the rider; and convex sides on the board which expand outward for being positioned under protruding elbows of the rider, wherein the rider can ride the device for body surfing.

* * * * *